US005970623A

United States Patent [19]

Tuggle

[11] Patent Number: 5,970,623

[45] Date of Patent: Oct. 26, 1999

[54] DRYER VENT CONNECTION

[76] Inventor: W. Gregory Tuggle, 17939 Dogwood Dr., Spring Lake, Mich. 49456

[21] Appl. No.: 09/071,791

[22] Filed: May 1, 1998

Related U.S. Application Data

[60] Provisional application No. 60/045,450, May 2, 1997.

[51] Int. Cl.[6] ..... F26B 25/06

[52] U.S. Cl. ..... 34/134; 34/235; 34/606

[58] Field of Search ..... 34/62, 104, 108, 34/129, 134, 138, 140, 175, 176, 179, 181, 235, 606, 609, 610; 285/147.1, 144.1, 181; 277/312, 314, 315; 248/56, 57, 636, 637; 16/485, 49, 51; 454/339, 271; 126/314, 317

[56] References Cited

U.S. PATENT DOCUMENTS

| | | | |
|---|---|---|---|
| 4,624,176 | 11/1986 | Steinke | 98/119 |
| 5,042,172 | 8/1991 | Foco et al. | 34/235 |
| 5,121,948 | 6/1992 | Anderson et al. . | |
| 5,145,217 | 9/1992 | Anderson et al. | 285/144.1 |
| 5,158,328 | 10/1992 | Anderson et al. | 285/147.1 |
| 5,199,190 | 4/1993 | Mayer et al. | 34/235 |
| 5,645,482 | 7/1997 | Moss et al. | 34/235 X |
| 5,653,631 | 8/1997 | Anderson et al. | 34/235 X |
| B1 5,121,948 | 10/1996 | Anderson et al. . | |

*Primary Examiner*—Henry Bennett
*Assistant Examiner*—Steven Gravini
*Attorney, Agent, or Firm*—Rader, Fishman & Grauer, PLLC

[57] ABSTRACT

A dryer duct assembly for connecting directing the exhaust air flow from a clothes dryer to an exhaust area, such as the exterior of a building. The dryer duct assembly comprises a rigid duct connected at one end to the rear of the dryer by an elbow connector and connected at another end to a flexible duct by a swivel sleeve connector. The rigid duct is of sufficient length such that its upper end is easily accessible to a worker standing at the front of the dryer, permitting the connection of the flexible duct to the rigid duct from the front of the dryer.

19 Claims, 2 Drawing Sheets

DRYER VENT CONNECTION

RELATED PATENT APPLICATIONS

This application claims the benefit of U.S. Provisional Patent Application Ser. No. 60/045,450, filed May 2, 1997.

BACKGROUND OF THE INVENTION

1. Field of the Invention

This invention relates to exhaust vent systems, and more particularly to exhaust vent systems for clothes dryers.

2. Description of the Related Art

Dryer exhaust conduits conduct substantial quantities of heated air and lint from the dryer to an external location. Because of the amount of thermal energy involved in the vented air and in the dryer itself, dryer hose installation must be carefully made. Usually, all metal exhaust conduits are used throughout the dryer vent system. The conduits typically have a large diameter opening on one end and a smaller diameter opening on another end, such that multiple conduits may be attached together through a telescopic fit. Two adjacent conduits are usually secured together in the telescopic arrangement by a band clamp, resulting in the kinking or crushing of one or both conduits. A kinked or crushed conduit could create highly undesirable air flow restriction causing reduced velocity resulting in lint build-up in locations of the kinked or crushed section, which is undesirable.

Dryers are most often fitted into a space just wide enough to receive them, i.e., confined between two walls, a washing machine and a wall, or a cabinet or shelving.

Typically, it is practically impossible to make the connections between dryer vent components or to install clamps around the components after the dryer is against the wall. Consequently, homeowners or technicians that frequently install dryers find it difficult to make an effective dryer exhaust hook-up with metal components. Making the all metal connections when the dryer is still spaced several feet from the wall too often results in not being able to get the 25 dryer close to the wall after the installation or, if the dryer is pushed close to the wall, the conduit sometimes undergoes additional crushing, kinking and/or flattening, resulting in poor air flow and possible fire hazard.

The problem has been further compounded in recent years due to a tendency to place dryers in small closets. Typically, such a closet will have a maximum clearance of about 33 inches. There is little or no room to connect the vent components together with their associated clamps, unless the dryer is outside of the closet at the time. Then, when it is pushed into the closet, it is easy for the all-metal conduit to get crushed, kinked, and/or flattened, resulting in poor air flow.

SUMMARY OF INVENTION

An object of this invention is to provide a duct connection system wherein two conduit assemblies can be frictionally held together. Another object of this invention is to provide a dryer ventilation duct system that enables a worker to complete the duct hook-up simply by leaning over the dryer after it is adjacent the wall and sliding a pair of components together. The system enables the dryer to be positioned closely adjacent the wall, e.g., 3 or 4 inches therefrom, yet without the duct being kinked, crushed, and/or flattened.

The invention accomplishes these objects by providing a dryer duct assembly that directs the exhaust air flow from a clothes dryer to a desired outlet area while permitting for the easy installation of the dryer duct assembly from a worker located at the front of the dryer. The dryer duct assembly comprises a rigid duct having a first end and a second end and being of a predetermined length. A first connector is adapted to connect the first end of the rigid duct to a dryer outlet vent. An exhaust duct extends from the rigid duct and is adapted to be connected to an outlet area. The exhaust duct has a first end and a second end. The first end of the exhaust duct is connected to the second end of the rigid duct by a second connector. The second end of the exhaust duct is adapted to be connected to the outlet area. The predetermined length of the duct is such that the person positioned at the front of the dryer can easily connect the second end of the rigid duct to the second connector.

Preferably, the rigid duct is substantially straight and extends upwardly along a back of the dryer. The predetermined length is such that the second end of the rigid duct does not extend beyond the top of the dryer. The first and second connectors can be any type of commonly used connector, including an elbow, a swivel connection, an articulated elbow, a swivel elbow, a swivel sleeve, and a flexible duct.

In a second embodiment, the invention is a clothes dryer assembly comprising a cabinet having a front wall and a back wall, which are connected by a top wall. The cabinet defines a clothes drying chamber having an inlet vent and an outlet vent, wherein the heated air used to dry the clothing enters the clothes drying chamber though the inlet vent and exits through the outlet vent. A rigid duct, having a predetermined length, has a first end and a second end. The first end of the rigid duct is connected to the outlet vent by a first connector. An exhaust duct is provided to connect the rigid duct to an outlet area. The exhaust duct has a first end and a second end. The first end of the exhaust duct is connected to the second end of the rigid duct by a second connector. The predetermined length of the rigid duct is such that the second connector can be connected to the second end of the rigid duct by a person standing adjacent the front of the cabinet.

In a third embodiment, the invention is a clothes dryer installation for connecting the clothes dryer to an exterior outlet. The clothes dryer installation comprises a clothes dryer having a cabinet with a front wall and back wall, connected by a top wall. The cabinet defines a clothes drying chamber having an inlet vent and an outlet vent, wherein heated air enters the clothes drying chamber through the inlet vent and exits through the outlet vent. A rigid duct of a predetermined length has a first end and a second end. The first end of the rigid duct is connected to the outlet vent of the clothes dryer by a first connector. An exhaust duct, having a first end and a second end, is connected to the rigid duct by the first connector and connected to an exterior outlet by a second connector. The predetermined length of the rigid duct is such that the second connector can be connected to the second end of the rigid duct by a person standing adjacent the front of the dryer.

BRIEF DESCRIPTION OF THE DRAWINGS

The invention will now be described with reference to the drawings wherein.

DESCRIPTION OF THE PREFERRED EMBODIMENTS

Figure 1:
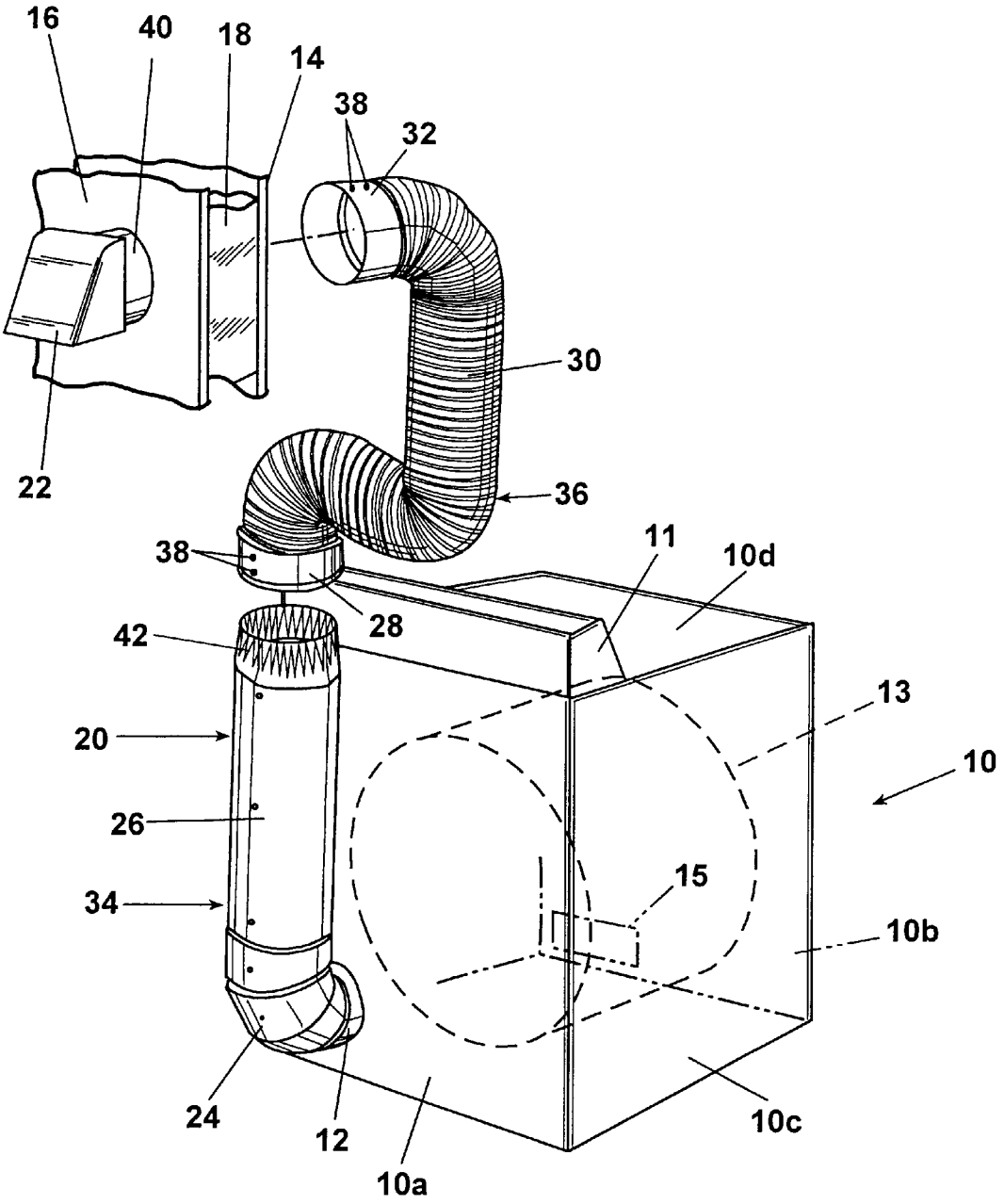
FIG. 1 is a perspective view of a dryer duct assembly of the present invention shown for attachment between an outside vent and the rear exhaust duct of a dryer.
Figure 2:
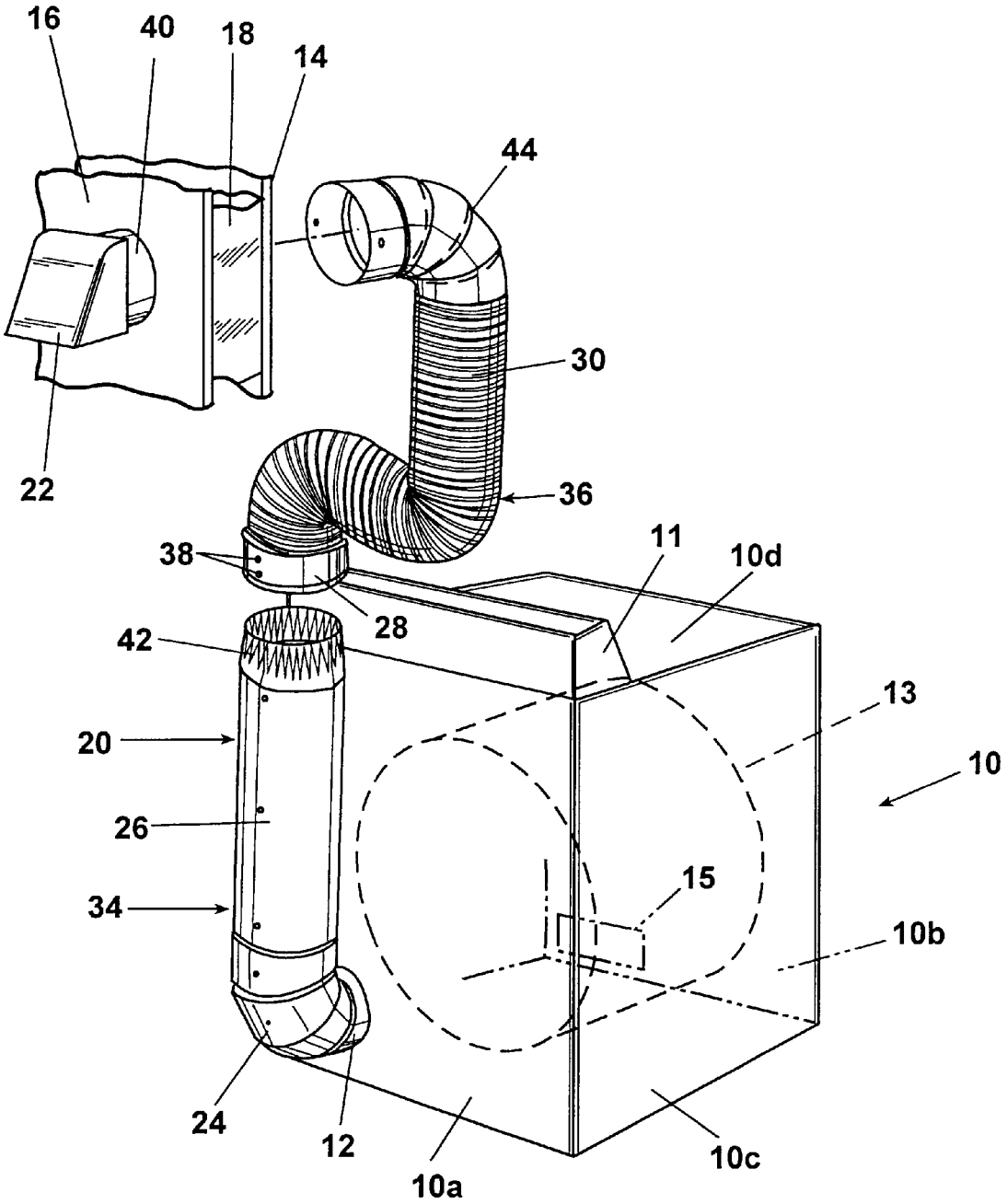
FIG. 2 is a perspective view of an alternative embodiment of the dryer duct assembly illustrating an elbow connector for connecting the duct assembly to the outside vent.

Referring now to FIGS. 1 and 2, a dryer 10 has a cabinet partially defined by back wall 10*a*, front wall 10*b*, side wall 10*c* and top wall 10*d*. A console 11 extends from the rear wall 10*a* and top wall 10*d*. A clothes dryer chamber 13 is located within the cabinet and has an air inlet 15 and an exhaust outlet 12. Heated air flows into the clothes dryer chamber 13 through inlet 15 and exhausts through the exhaust outlet 12, extends rearwardly from the dryer rear wall 1*a*. In a common installation, dryer 10 is positioned adjacent to a first wall 14 and a second wall or other structure (not shown). A plurality of studs 18 (only one of which is shown) are usually located between the wall 14 and another wall 16 that defines another room or the outside of a building structure.

FIG. 1 shows an exemplary embodiment of a duct system 20 which connects an outside vent 22 to the dryer exhaust outlet 12. The duct system 20 includes a first universal elbow section 24, a rigid tubular conduit section 26, a sleeve 28, a flexible metallic duct section 30, and a second sleeve 32. These components are preferably constructed of sheet metal material. Preferably, the first elbow section 24 is secured through rivets, welding, etc., to a first end of the rigid conduit section 26 to form a first conduit assembly 34. Likewise, the sleeve 28 and second sleeve 32 are preferably secured in a similar manner to opposite ends of the second flexible duct section 30 to form a second conduit assembly 36. In this manner, the first and second assemblies 34, 36 can be shipped in kit form for final assembly at the dryer installation site. The flexible duct section 30 is preferably formed of a thin corrugated metal, and is capable of being extended, retracted, and oriented in various positions.

In use, the dryer 10 is initially spaced away from the wall 14 to provide access to the dryer exhaust outlet 12 and an inner sleeve 40 of the outside vent 22. The first conduit assembly 34 is positioned adjacent to the rear wall 11 of the dryer 10 such that a free end of the first universal elbow section 24 is located over the dryer exhaust outlet 12. The inner diameter of the free end of the first elbow section 24 is slightly larger than the outer diameter of the exhaust duct 12 and has a plurality of circumferentially spaced dimples 38 that protrude inwardly for engaging the outer surface of the exhaust duct 12. When the free end of the first elbow section 24 is positioned around the exhaust duct 12, the dimples 38 are deformed to thereby frictionally secure the first duct assembly 34 to the exhaust duct 12. Further clamping is not required. The dimples 38 are described in greater detail in my co-pending U.S. Provisional Application No. 60/015,744 filed on Apr. 23, 1996, the disclosure of which is hereby incorporated by reference. Due to the ease of connection afforded by the dimples 38, a user may simply grasp the rigid conduit section 26 at a free end 42 thereof, lean over the top of the dryer 10, and force the first elbow section 24 over the exhaust duct 12 to complete installation of the first conduit assembly 34.

The inner diameter of the second sleeve 32 of the second conduit assembly 36 is slightly larger than the outer diameter of the vent inner sleeve 40. The second sleeve 32 also preferably includes a plurality of circumferentially spaced and inwardly extending dimples 38 to thereby frictionally secure the second duct assembly 36 to the outside vent 22. Alternatively, the outer diameter of second sleeve 32 can be slightly smaller than the inner diameter of sleeve 40 with the dimples 38 protruding outwardly of the second universal elbow section 32 or inwardly of the sleeve 40. Once the second conduit assembly 36 is attached to the outside vent 22, the dryer 10 can be placed in its final position while holding the sleeve 28 above the dryer. The first and second conduit assemblies 34, 36 can then be connected by slipping the sleeve 28 over the rigid conduit section 26. Again, a plurality of inwardly extending dimples 38 are spaced circumferentially around the free end of the sleeve 28 to thereby frictionally hold the rigid conduit section 26 thereto. The duct system 20 can then be rotated and adjusted as needed to hide the duct system from view.

FIG. 2 illustrates an alternative duct assembly construction which is identical to the assembly of FIG. 1, except that the sleeve 32 is replaced by an elbow 44. Preferably, the elbow 44 is a swivel sleeve, which can rotate relative to the second conduit 30. It should be noted that the connectors for connecting the conduits 26 and 30 can be any of the well known connectors, such as an elbow, swivel elbow, articulated elbow, sleeve, swivel sleeve, and flexible duct.

The duct system according to the invention is advantageous over the prior art because it can be readily installed by one of little skill and, in fact, no skill in the metal working field, to produce a safe dryer exhaust duct arrangement. The installation is simplified because the rigid duct is installed while the dryer is away from the wall. The dryer is then pushed against the wall where the rigid duct is still readily accessible to complete the installation by mounting the second conduit from the front of the dryer.

Conceivably, various details of this invention, as illustrated in the preferred embodiment, may be modified to suit a particular type of installation. Hence, the invention is not intended to be limited to the specific embodiments set forth as illustrated.

I claim:

1. A dryer duct assembly for directing exhaust air flow from a clothes dryer to a desired outlet area, the clothes dryer being of the type having a clothes drying chamber within a cabinet in communication with an inlet vent and an outlet vent, wherein heated air enters the clothes drying chamber through the inlet vent and exits through the outlet vent to be directed to the outlet area, the dryer duct assembly comprising:

a rigid duct with a first end and a second end and having a predetermined length;

a first connector on the rigid duct first end, adapted to connect the first end of the rigid duct to a dryer outlet vent;

a second connector on the rigid duct second end; and an exhaust duct having a first end and a second end, the exhaust duct first end being adapted to connect with the second connector, and the exhaust duct second end being adapted to communicate with an outlet area;

wherein the length of the rigid duct is dimensioned such that the exhaust duct first end can be connected to the rigid duct second end by a person standing in the front of a clothes dryer cabinet when the rigid duct first end is connected to the clothes dryer outlet vent.

2. The dryer duct assembly according to claim 1 wherein the rigid duct is made from sheet metal.

3. The dryer duct assembly according to claim 1 wherein the rigid duct is substantially straight.

4. The dryer duct assembly according to claim 1 wherein the rigid duct is adapted to extend upwardly along the back of a clothes dryer cabinet.

5. The dryer duct assembly according to claim 4 wherein the length dimension is such that the rigid duct second end does not extend beyond the top of the clothes dryer cabinet when the rigid duct first end is connected to the clothes dryer outlet vent.

6. The dryer duct assembly according to claim 5 wherein the length dimension is such that the second connector does not extend beyond the top of the clothes dryer cabinet when the rigid duct first end is connected to the clothes dryer outlet vent.

7. The dryer duct assembly according to claim 1 wherein the first connector and second connector is selected from a group consisting of an elbow, a swivel connection, an articulated elbow, a swivel elbow, a swivel sleeve, and a flexible duct.

8. The dryer duct assembly according to claim 1 wherein the exhaust duct is a flexible duct.

9. A clothes dryer assembly comprising:

a cabinet having a front wall and a back wall connected by a top wall and defining a clothes drying chamber having an inlet vent and an outlet vent, wherein heated air enters the clothes drying chamber through the inlet vent and exits through the outlet vent;

a rigid duct with a first end and a second end and having a predetermined length;

a first connector connecting the first end of the rigid duct to the dryer outlet vent; and an exhaust duct having a first end and a second end and the second end is adapted to be connected to an outlet area;

a second connector connecting the second end of the rigid duct to the first end of the second duct; and wherein the predetermined length of the rigid duct is such that the second connector can be connected to the second end of the rigid duct by a person standing adjacent the front of the cabinet.

10. The dryer duct assembly according to claim 9 wherein the rigid duct is substantially straight.

11. The dryer duct assembly according to claim 9 wherein the rigid duct extends upwardly along the back wall of the cabinet.

12. The dryer duct assembly according to claim 11 wherein the predetermined length is such that the second end of the rigid duct does not extend beyond the top of the cabinet.

13. The dryer duct assembly according to claim 12 wherein the predetermnined length is such that the second connector does not extend beyond the top of the cabinet.

14. The dryer duct assembly according to claim 9 wherein the first connector and second connector is selected from a group consisting of an elbow, a swivel connection, an articulated elbow, a swivel elbow, a swivel sleeve, a coupler, and a flexible duct.

15. The dryer duct assembly according to claim 9 wherein the exhaust duct is a flexible duct.

16. A clothes dryer installation for connecting the clothes dryer to an exterior outlet, comprising:

a clothes dryer having a cabinet with a front wall and a back wall connected by a top wall and defining a clothes drying chamber having an inlet vent and an outlet vent, wherein heated air enters the clothes drying chamber through the inlet vent and exits through the outlet vent;

a rigid duct with a first end and a second end and having a predetermined length;

a first connector connecting the first end of the rigid duct to the dryer outlet vent;

an exhaust duct having a first end and a second end and the second end;

a second connector connecting the second end of the rigid duct to the first end of the second duct;

an exterior outlet connected to the second end of the second duct; and wherein the predetermined length of the rigid duct is such that the second connector can be connected to the second end of the rigid duct by a person standing adjacent the front of the cabinet.

17. The dryer duct assembly according to claim 16 wherein the rigid duct is substantially straight.

18. The dryer duct assembly according to claim 16 wherein the first connector and second connector are selected from a group consisting of an elbow, a swivel connection, an articulated elbow, a swivel elbow, a swivel sleeve, a coupler, and a flexible duct.

19. The dryer duct assembly according to claim 16 wherein the exhaust duct is a flexible duct.

* * * * *